United States Patent [19]

Hogendyk

[11] 3,955,251

[45] May 11, 1976

[54] FABRIC SPREADING AND STRETCHING APPARATUS

[76] Inventor: Warren Hogendyk, 4017 Bell, NE., Grand Rapids, Mich. 49505

[22] Filed: June 16, 1975

[21] Appl. No.: 587,420

Related U.S. Application Data

[62] Division of Ser. No. 518,490, Oct. 29, 1974.

[52] U.S. Cl. ..... 26/80

[51] Int. Cl.[2] ..... D06C 5/00

[58] Field of Search ..... 26/55 R, 56; 38/44

[56] References Cited

UNITED STATES PATENTS

| | | | |
|---|---|---|---|
| 2,507,599 | 5/1950 | Johnson | 26/55 R |
| 2,517,067 | 8/1950 | Wedler | 26/55 R |
| 2,623,263 | 12/1952 | Dungler | 26/55 R |
| 2,795,243 | 6/1957 | Strazzeri | 26/55 R UX |
| 3,217,361 | 11/1965 | Ryan et al. | 26/55 R UX |
| 3,334,391 | 8/1967 | Kusters et al. | 26/55 R |

FOREIGN PATENTS OR APPLICATIONS

| | | | |
|---|---|---|---|
| 2,106,455 | 8/1972 | Germany | 26/55 R |
| 690,283 | 4/1953 | United Kingdom | 26/55 R |
| 46-5277 | 2/1971 | Japan | 26/55 R |

*Primary Examiner*—Robert R. Mackey

*Attorney, Agent, or Firm*—Price, Heneveld, Huizenga & Cooper

[57] ABSTRACT

A spreading and stretching apparatus for textile calender machines especially adapted for use with knitted and other tubular fabrics to prevent the pinching and tearing of the fabric as it is drawn into the calender rolls of the machine. Magnetic repulsion means are included to constantly bias and space a spreading and stretching frame away from the calender rolls as the fabric is drawn into the rolls over and around the frame. Variable speed feeding rollers enable controlled feeding of the tubular fabric into the calender rolls.

7 Claims, 12 Drawing Figures

FABRIC SPREADING AND STRETCHING APPARATUS

This is a division of application Ser. No. 518490, filed Oct. 29, 1974.

BACKGROUND OF THE INVENTION

This invention relates to apparatus for processing tubular textile fabrics and, more particularly, to apparatus used with textile calender machines for spreading and stretching such fabrics.

Textile calender machines for pressing and sizing fabrics, and especially tubular knitted fabrics, in preparation for use of the fabric in the manufacture of clothing and the like are well known. Such machines normally include apparatus for steaming the material as well as a series of heated calender rolls for pressing the fabric after the steaming operation. Since most modern fabrics are manufactured by knitting yarn into continuous cylindrical tubes, more recent prior existing calender machines have included spreading and stretching apparatus for laterally stretching the tubular material before its insertion in the calender rolls. The steaming and pressing operations, therefore, size the tubular material into proper condition for later manufacturing processes.

A common problem with prior known calender machines using such spreading apparatus, has been the pinching, tearing, or other damage of the tubular fabrics as they are drawn into the calender rolls. Such damage results from the fact that the stretching apparatus, which is normally completely encloed by the tubular fabric, is drawn tightly against the mating calender rolls as the opposing layers of the tubular fabric are drawn therebetween. The force of the spreading apparatus being drawn against the rolls, pinches the fabric causing resultant excessive stretching or tearing. This problem has been accentuated recently with the advent of numerous types of more delicate, knitted tubular fabrics which are less resistant to such abrasion and stress than prior known fabrics.

Another problem encountered with prior machines has been the inability to accurately control the speed at which the entire width of the tubular knitted fabric is drawn into the calender rolls. Since the spreading apparatus over which the tubular fabric is drawn resists and thereby slows down the feeding of the material along the edges of the material, the center of the material tends to be drawn into the calender rolls at a faster rate causing a warping or arcuate stretching of the material across its width.

The present invention solves these and other problems in providing a spreading and stretching apparatus which prevents the pinching and tearing of even delicate knitted tubular fabrics as well as the accurate control of the feeding of the fabric over the spreading apparatus into the calender rolls.

SUMMARY OF THE INVENTION

Accordingly, it is an object and purpose of the present invention to provide a spreading, stretching, and feeding apparatus for use with tubular textile fabrics in textile calender machines which prevents pinching and tearing of the fabric while allowing accurate control and feeding of the fabric.

In one aspect, the invention includes a stretching apparatus comprising a frame for stretching and spreading a length of such tubular fabric. The frame is adapted to be inserted within and entirely surrounded by the tubular fabric. Support means are included external of the frame and fabric when said fabric is stretched over and around said frame for locating the frame with respect to the fabric. Magnetic means are included providing a magnetic repulsion force for repelling the frame away from said support means to conterbalance the force of the fabric against the frame when the fabric is stretched over the frame and drawn toward the support means.

In other aspects of the invention, the stretching apparatus is combined with a calender machine and rotatable feeding means for gripping the lateral edges of the tubular fabric and controlling the feeding of the fabric to the calender rolls on the calender machine.

An important principal of the invention is, therefore, the use of the force of magnetic repulsion to constantly bias and space a spreading and stretching frame enclosed within the tubular fabric away from the calender rolls to prevent pinching, tearing, and other damage to the fabric. An additional advantage is that the spreading apparatus may be used with cooperating feeding rollers gripping the edges of the tubular material so as to control the feeding speed of the entire width of the material as it is stretched over the apparatus.

While the apparatus is principally directed to the prevention of damage to and the control of the textile materials, the spreading apparatus has the additional advantage of enabling the machine operator to initiate the feeding of the material in the large calender rolls using the end of the movable frame thereby obviating the need to bring his or her hands close to the contact area or pinch point of the rollers.

These and other objects, advantages, purposes, and features of the invention will become more apparent from a study of the following description taken in conjunction with the drawings.

DESCRIPTION OF THE PREFERRED EMBODIMENT

Figure 1:
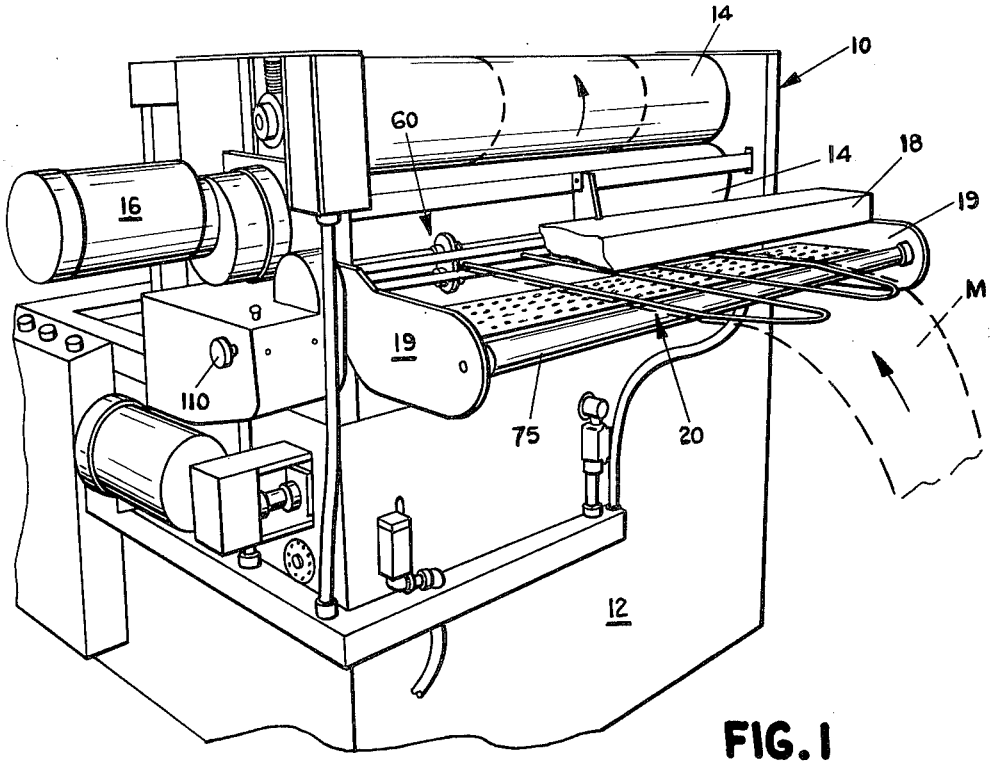
FIG. 1 is a fragmentary, perspective view of a textile calender machine including the spreading, stretching, and feeding apparatus of the present invention.
Figure 4:
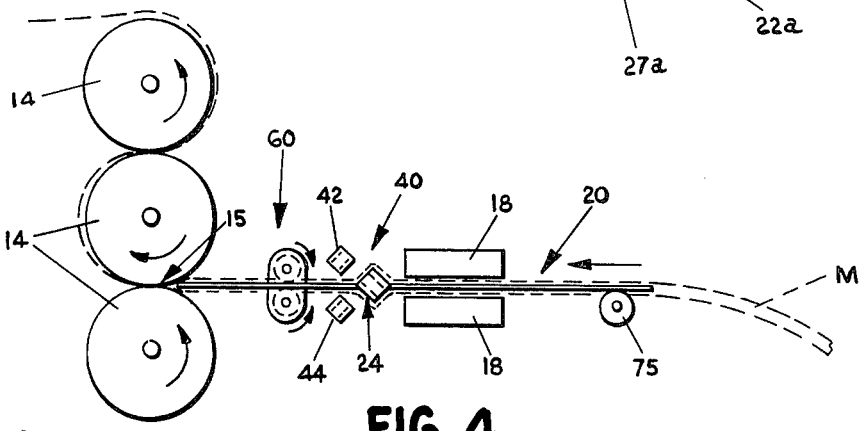
FIG. 4 is a schematic side view of the spreading and feeding apparatus.

Referring now to the drawings in greater detail, FIG. 1 illustrates a textile calender machine 10 having an upstanding base 12 supporting a series of three elongated cylindrical calender rolls 14. As is best seen in FIG. 4, the calender rolls 14 have their central rotational axes parallel to one another and spaced in vertical alignment one above the other such that the outer circumferences of the rolls meet and touch one another at contact area or nip 15 to grip and pull fabric therebetween. The rolls 14 are driven by appropriate gearing from an electric motor 16. The machine 10 also includes a pair of vertically aligned steam boxes 18 for steaming the fabric which are mounted on a pair of arms 19 extending outwardly, upstream and ahead of the calender rolls 14. The machine is designed to process continuous lengths of knitted and other tubular fabrics represented at M in FIGS. 1, 2, 4, and 5. The fabric is drawn or pulled between the steam boxes 18 and into, around, and through calender rolls 14 as shown in FIGS. 1 and 4. The steam dampens the fabric and the calender rolls, which are preferably heated by appropriate apparatus (not shown), press and size the fabric after which it is rolled or folded for later use.

In accordance with the principal aspect of the invention, a spreading and stretching frame 20 extends generally perpendicularly outwardly, upstream and ahead of calender rolls 14 between steam boxes 18 in order to laterally stretch and spread the fabric M prior to its insertion in the calender rolls. The stretching apparatus includes magnetic repulsion apparatus 40 for constantly biasing and counterbalancing the force of the fabric exerted against the stretching frame 20 caused by the frictional engagement and resistance to stretching of the fabric as it is drawn over and around the stretching frame. Such repulsion force spaces the frame away from the rolls 14 to prevent pinching, tearing, and other damage to the fabric as described above.

The present invention also includes an overfeed roller assembly 60 located generally between the magnetic repulsion apparatus 40 and the calender rolls 14. Overfeed roller assembly 60 grips the lateral edges of the tubular fabric M and controls the speed of insertion of the fabric into the rolls 14.

Figure 2:
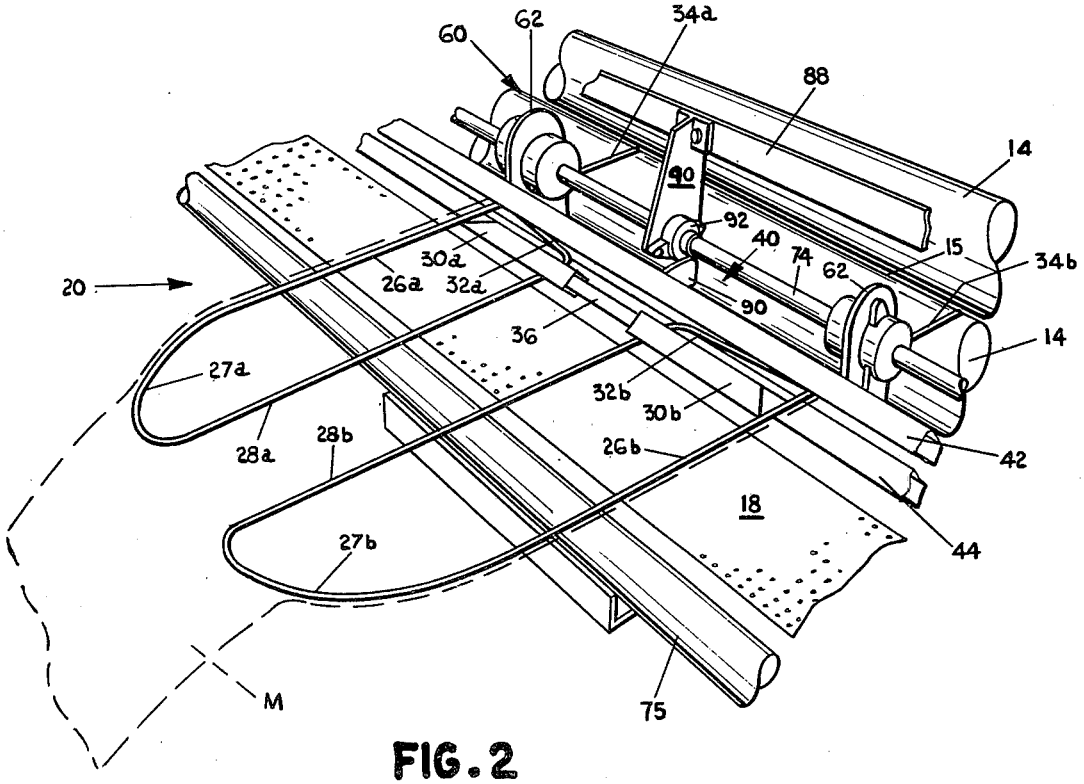
FIG. 2 is a fragmentary, perspective view of a portion of the calender machine shown in FIG. 1 with portions including the upper steam box broken away to reveal the spreading, stretching, and feeding apparatus.
Figure 3:
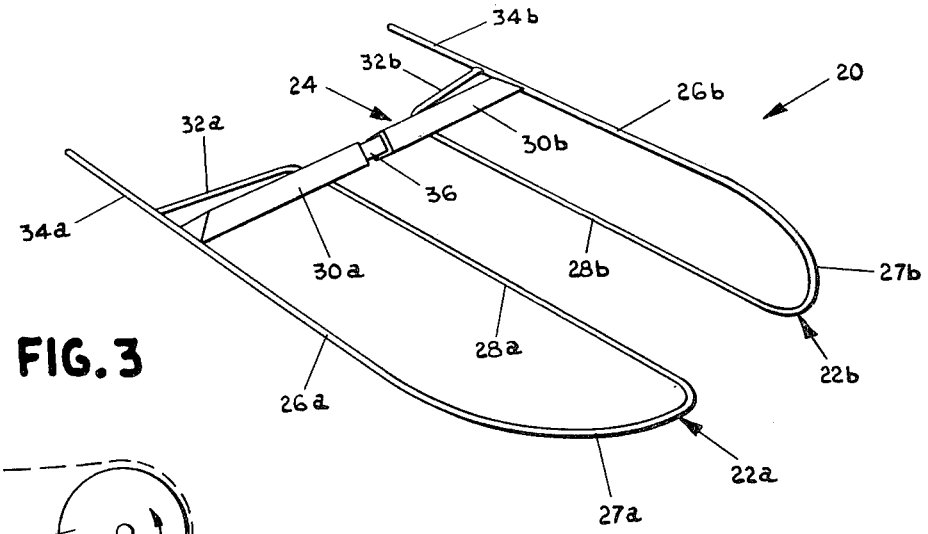
FIG. 3 is a perspective view of the spreading and stretching frame.

Referring to FIGS. 2 and 3, stretching and spreading frame 20 includes left and right stretching members 22*a* and 22*b*, respectively, connected together and spaced generally horizontally apart by a tubular assembly 24. Stretching members 22*a*, 22*b* include elongated, lateral, outside stretching rods 26*a* and 26*b* extending generally parallel to the direction in which the tubular fabric is pulled over the frame. Outside rods 26*a* and 26*b* include arcuate portions 27*a* and 2*b*, respectively, for initially contacting and expanding the tubular fabric in the manner shown best in FIG. 2. Arcuate portions 27*a* and 2*b* merge into inside elongated bracing rods 28*a* and 28*b* which extend generally parallel to outside rods 26*a* and 26*b*. Each pair of inside and outside rods 26 and 28 are spaced apart by hollow connecting tubes 30*a* and 30*b*, respectively, extending generally transverse to the rods. Rods 28*a*, 28*b* extend through tubes 30*a*, 30*b* and form additional bracing rods 32*a*, 32*b* extending from the rear side of tubes 30*a* and 30*b* to the extended ends 34*a* and 34*b* of lateral stretching rods 26*a*, 26*b*.

As is best seen in FIG. 3, connecting tubes 30*a*, 30*b* are generally axially aligned with one another and joined together by a separate tubular member 36 telescoped within the ends of the tubes. Member 36 abuts rods 28*a*, 28*b* extending through the tubes and has a slightly smaller and matching cross-sectional area than the tubes. Tube 36 may be selected in different lengths such that the opposing stretching members and lateral stretching rods 26*a* and 26*b* are spaced closer together or farther apart in order to match the stretching dimensions for the desired tubular fabric.

In the preferred embodiment, tubular members 30*a*, 30*b* and 36 are square in cross section and are mounted on the frame 20 such that the flat sides of the exterior of the tubes are inclined to the vertical in a diamond-like arrangement when viewed from their ends. Such arrangement allows the magnets in the magnetic repulsion apparatus to be inclined to the vertical within the tubular members for optimum repulsion force as will be explained more fully below. The flat sides also resist vertical twisting of stretching members 22*a*, 22*b* with respect to one another. Of course, tubular assembly 24 may be a continuous tube without a separate, telescoping central section 36 such that the framework will be of a desired permanent lateral dimension for stretching a single size tubular fabric.

Figure 5:
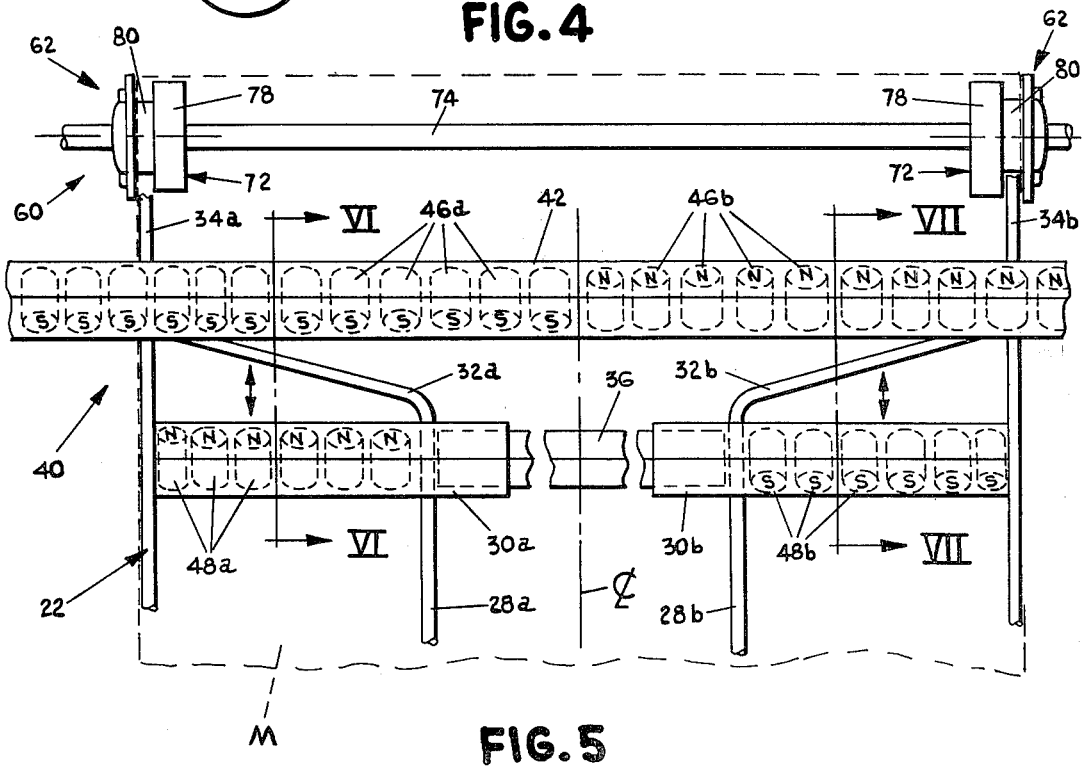
FIG. 5 is a fragmentary, plan view of the spreading and feeding apparatus illustrating the magnetic repulsion means and rotatable feeding means.

As is best seen in FIGS. 2, 4, and 5, stretching frame 20 is located and positioned on calender machine 10 by magnetic repulsion apparatus 40 such that it extends through overfeed roller assembly 60 to a position immediately adjacent the pinch or contacting areas of the two lower calender rolls 14. In this respect, the frame 20 extends generally perpendicularly outwardly from the pinch area or nip 15 of the rolls with the ends of extending ends 34*a*, 34*b* extending to a point immediately adjacent and slightly spaced from that pinch area. Thus, as shown in FIG. 4, the tubular fabric envelope is drawn over and around the frame 20, through magnetic repulsion apparatus 40, through feed roller assembly 60, around the end of extensions 34*a*, 34*b* and through rollers 14. The magnetic repulsion apparatus constantly counteracts the force of the fabric being drawn over the framework to space the end portions 34*a*, 34*b* of rods 26*a*, 26*b* slightly away from the rollers to prevent pinching, tearing, and damage to the processed fabric.

Magnetic repulsion means 40 (FIGS. 2 and 4–7) includes a pair of elongated, parallel hollow tubes 42 and 44 extending transversely across machine 10 between arms 19 upstream and ahead of calender rolls 14. Tubes 42 and 44 are generally parallel to the rotational axes of rolls 14, are in vertical alignment with one another, and are spaced vertically apart to allow insertion of frame 20 therethrough. Magnetic repulsion force is derived from a series of generally cylindrical permanent magnets 46 and 48, respectively, mounted and housed in tubes 42, 44 and connecting tubes 30*a* and 30*b*. Tubes 42 and 44 are each filled with magnets 46 from one end to the other. In the preferred embodiment, each tube 42 and 44 includes forty-five (45) permanent magnets. Only the connecting tubes 30*a* and 30*b* include magnets in frame 20 with each connecting tube including seven magnets in the preferred embodiment.

Figure 6:
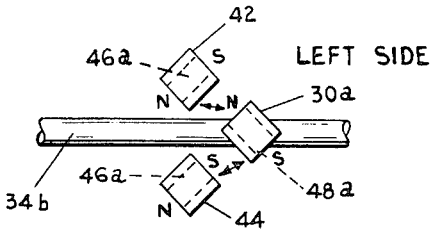
FIG. 6 is a fragmentary, side elevation of the spreading apparatus taken along plane VI—VI of FIG. 5.
Figure 7:
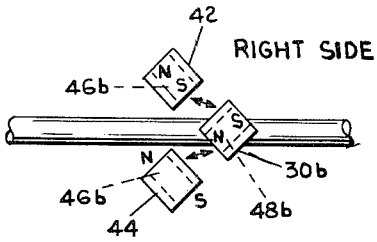
FIG. 7 is a fragmentary, side elevation of the spreading apparatus taken along plane VII—VII of FIG. 5.

As will be understood from FIGS. 5–7, each of the magnets 46 and 48 has two magnetic poles designated north (N) and south (S) in the figures. Generally, the magnets are arranged such that the magnetic poles of magnets 46 are reversed with respect to the magnetic poles of magnets 48 in order to provide the repulsion force. For best results, however, it has been found that magnets 46 and 48 should be inclined to the vertical as shown in FIGS. 5–7 and reversed with respect to one another on the left and right sides of the apparatus such that the frame 22 can be inverted without altering the repulsion function of the magnetic assembly.

In this respect, magnets 46*a* in tubes 42 and 44 on the left side of the centerline of the magnetic means 40 are arranged as shown in FIG. 6 with the south poles pointing upwardly and the north poles pointing downwardly. Magnets 48*a* in the left connecting tube 30*a* are reversed with respect to magnets 46*a*, are inclined at 90° to magnets 46*a*, and have their north poles extending upwardly and their south poles extending downwardly. The several magnets on the right-hand side of tubes 42 and 44 and connecting tube 30*b* are positioned oppositely those on the left side. Thus, as shown in FIG. 7, the magnets 46*b* in tubes 42 and 44 are positioned with their longitudinal axes at 90° to the axes of magnets 46*a* on the left-hand side and the magnetic north poles are extending upwardly and the south poles downwardly. Magnets 48*b* are inclined at 90° to magnets 46*b* with their north poles pointing downwardly and their south poles upwardly. Regardless of the side of frame 22 that is facing upwardly, the left and right-hand magnetic assembly portions will always have the magnets positioned as shown in FIG. 5. The operator of the machine, therefore, need not be careful to portion the same side of the frame upwardly but may invert the frame with the magnetic repulsion assembly always functioning in the same manner.

As will now be apparent from FIGS. 6 and 7, should the force of the fabric against the frame force the frame toward tubes 42 and 44, the magnetic repulsion force will operate in the direction indicated by the small arrows therebetween with the like poles of magnets 46 and 48 being repelled away from one another as indicated. Thus, the repulsive force will be maintained regardless of the distance between 42, 44 and 30*a* and 30*b*.

In the preferred embodiment, magnets 46 and 48 are of the sintered variety including a mixture of ceramic and permanently magnetized particles. They are preferably formed in a right cylindrical shape such that they may be arranged and oriented with their longitudinal cylindrical axes as described above. One suitable type has been found to be the Eriez Magnet sold by Eriez Magnet Co., Erie, Pennsylvania. Such magnets provide a maximum of three (3) pounds of repulsive force when coupled with an identical magnet. The number of magnets, and thus, the total repulsion force, is chosen depending on the size and weight of the frame 20 and the weight, size, and texture of the fabric M being stretched.

Figure 8:
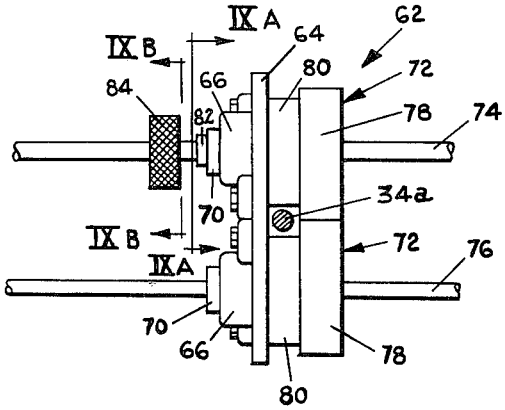
FIG. 8 is a fragmentary, front elevation of a portion of the rotatable feeding apparatus.

Referring to FIGS. 1, 2, 4, 5, and 8, the overfeed roller assembly 60 includes a pair of identical gripping roller units 62 mounted generally between the magnetic repulsion apparatus 40 and calender rolls 14 for gripping and feeding of the lateral edges of the tubular fabric M. As is best seen in FIG. 8, each roller unit 62 includes a generally vertically oriented support plate 64 having a pair of identical bearing blocks 66 mounted on one side thereof vertically above one another. Bearing sleeves 70 extend through bearing blocks 66 and support plate 64 and rotatably support a pair of gripping rollers 72 one above the other in vertical alignment on drive shafts 74 and 76. Each gripping roller 72 includes a large diameter fabric gripping portion 78 and a reduced diameter portion 80 generally between support plate 64 and the large diameter portion 78. As will be seen in FIG. 8, the extending ends 34*a*, 34*b* of frame 20 pass between the reduced diameter portions 80 of rollers 72 adjacent support plate 64 such that they extend to the position immediately adjacent calender rolls 14. The rollers are designed to exert no pulling force on the stretching frame but allow the extending ends to pass freely therethrough. However, rollers 72 vertically support and stabilize ends 34*a*, 34*b* of the frame in cooperation with freely rotating roller 75 which supports the opposite end of the frame (FIGS. 1, 2, and 4). The large diameter circumferential portions 78 contact one another along their outer circumferences so as to positively grip the two layers of the tubular fabric M passing therebetween.

Figure 9A:
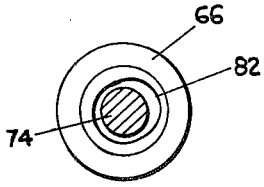
FIG. 9A is a sectional view taken along plane IX-A—IXA of FIG. 8.
Figure 9B:
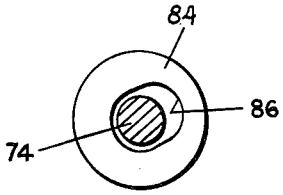
FIG. 9B is a sectional view taken along plane IX-B—IXB of FIG. 8.

As shown in FIGS. 1, 2, and 5, drive shafts 74 and 76 extend across the entire width of machine 10 and have their axes generally parallel to the rotational axes of calender rolls 14. Support for shafts 74 and 76 is provided by a support bar 88 (FIGS. 1 and 2) extending across the width of the machine above the drive shafts 74, 76. Bar 88 includes a plate 90 extending downwardly. Another plate 90 extends upwardly from a portion of the machine below shafts 74, 76. Each plate 90 includes a bearing block 92 for rotatably engaging and supporting one of the drive shafts. Roller units 62 may be individually slid along the vertically aligned drive shafts such that the spacing between the two units 62 may be adjusted to fit any width tubular fabric M. The roller units are locked in the desired position along drive shafts 74, 76, by a collar 84 telescoped over one of the shafts. One of the bearing blocks 66 on each unit 62 includes an eccentric shoulder 82 (FIGS. 8 and 9A) designed to mate with and be received in an eccentrically shaped, corresponding recess 86 in apertured collar 84 (FIG. 9B). When the unit 62 is correctly positioned to grip one lateral edge of the material, collar 84 is slid over shoulder 82 and rotated thereby squeezing eccentric shoulder 82 against shaft 74 and locking the entire unit in place.

Figure 11:
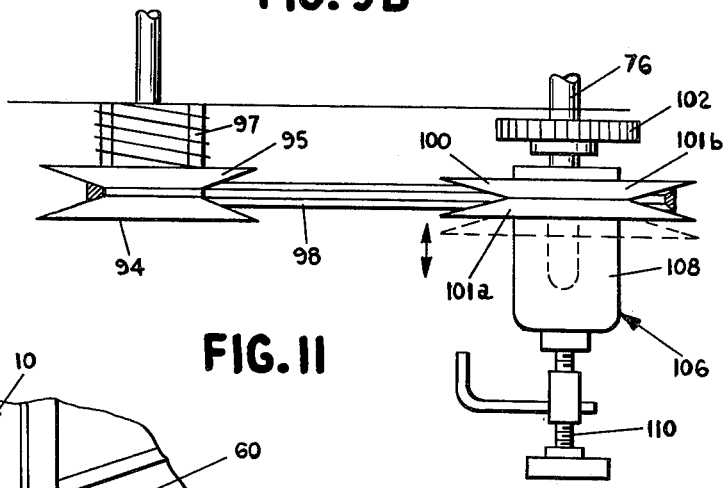
FIG. 11 is a plan view of the drive mechanism for the rotatable feeding apparatus taken along plane XI—XI of FIG. 10.
Figure 10:
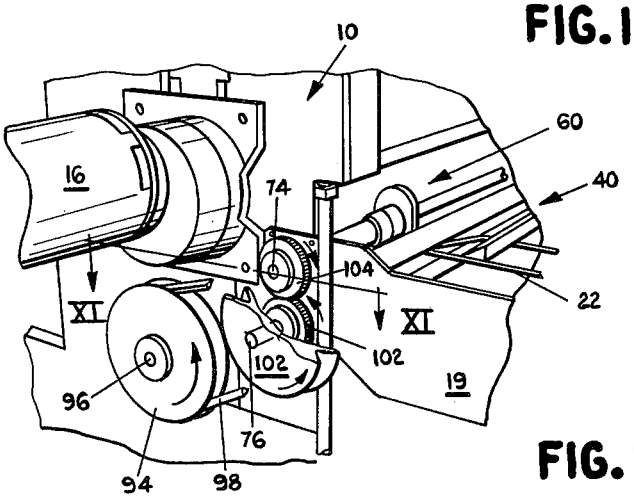
FIG. 10 is a fragmentary, perspective view of a portion of the calender machine illustrating the drive mechanism for the rotatable feeding apparatus.

As shown in FIGS. 10 and 11, driving power for the drive shafts 74, 76 of the overfeed roller assembly is provided by a pulley-and-belt arrangement on one side of the machine. A variable diameter pulley 94 is mounted on the extending shaft 96 of the bottom calender roll 14. An endless belt 98 extends around pulley 94 and an adjustable diameter pulley 100 mounted on the extending end of lower drive shaft 76. A gear 102, fixedly secured between pulley 100 and the side of the machine on shaft 76, drives a similar gear 104 mounted on the extending end of drive shaft 74. Shafts 74 and 76 are thus rotated in opposite directions in order to oppositely rotate the vertically aligned pairs of gripping rollers 72.

Pulley 100 includes a diameter adjusting mechanism 106 including a housing 108 mounting an adjusting screw 110 which may be rotated to move pulley half 101*a* toward or away from the remaining pulley half 101*b*. Pulley 94 includes a movable pulley half 95 which is biased by a spring 97 to take up the tension on belt 98 as the diameter of pulley 100 is varied. Thus, by changing the diameter of pulleys 94 and 100, the rotational speeds of shafts 74, 76 and thus the two pair of gripping rollers 72 in unit 62 may be adjusted with respect to the constant rotational speed of the calender rolls 14. Since the frictional force of the material sliding over the outside edges of frame 20 tends to slow those lateral edges of the material with respect to the speed of the center of the material as the material enters the calender rolls, the speed of the gripping rollers contacting either lateral edge of the material may be adjusted to feed the edges at the same rate as the center of the material. Hence warping and stretching of the material across its width is prevented as the material is fed into the calender rolls.

The operation of the present invention will now be understood. Tubular knitted or other type textile fabric or material M is drawn into the series of calender rolls 14 through a pair of steam boxes 18 and over and around stretching frame 20. The force of the material against the stretching frame forces the frame toward the calender rolls. The magnetic repulsion force of the magnetic apparatus 40 conterbalances that force of that fabric against the frame to constantly bias and space the frame away from the calender rolls to prevent pinching, tearing, and other damage to the fabric as it enters those rolls. The frame is, therefore, a free-floating frame entirely surrounded and enclosed within the tubular material during operation and is spaced from the locating tubes 42, 44 only by magnetic repulsion forces without any physical contact between tubular members 24 of frame 20 and the tubes 42, 44.

Control of the feeding of the laterally stretched fabric is provided by the overfeed roller assembly 60 with the gripping rollers 72 engaging the opposite lateral sides of the fabric to control the feeding speed thereof into the calender rolls. Such control of the feeding prevents warpage and misalignment of the fabric across its width as it is processed by the calender rolls.

Frame 22 also provides a means for inserting the beginning end of fabric M between rolls 14 without bringing one's hands close to the rolls. The fabric is pulled over the frame, folded over the frame end, and pushed between rolls 14 until gripped.

While one form of the invention has been shown and described, other forms will now be apparent to those skilled in the art. Therefore, it will be understood that the embodiment shown in the drawings and described above is merely for illustrative purposes and is not intended to limit the scope of the invention which is defined by the claims which follow.

The embodiments of the invention in which an exclusive property or privilege is claimed are defined as follows.

I claim:

1. Stretching apparatus adapted for use with a calender machine for processing tubular textile fabrics to prevent damage to the fabric comprising a frame for stretching and spreading a length of such tubular textile fabric, said frame adapted to be inserted within and entirely surrounded by the tubular fabric; support means external of said frame and fabric when said fabric is stretched over and around said frame for locating said frame with respect to said fabric; and magnetic repulsion means providing a magnetic repulsion force for repelling said frame away from said support means to counterbalance the force of said fabric against said frame when said fabric is stretched over said frame and drawn toward said support means.

2. The stretching apparatus of claim 1 wherein said magnetic repulsion means include a plurality of magnets, each of said magnets including two opposite magnetic poles; a first portion of said magnets being located on said frame and the second and remaining portion of said magnets located on said support means; said magnets in said first portion having their magnetic poles generally reversed with respect to the poles of said second portion of said magnets.

3. The stretching apparatus of claim 2 wherein said frame includes a central axis extending generally parallel to the direction in which said fabric is drawn over said frame, a pair of elongated stretching members extending generally parallel to said axis, and connecting means extending transversely between said stretching members for spacing said members laterally apart; said support means extending generally transverse to said central axis of said frame; said connecting means including said first portion of said magnets.

4. The stretching apparatus of claim 3 wherein said magnets each have a longitudinal axis, the axes of said magnets in said connecting means being inclined with respect to the axes of said magnets in said support means.

5. The stretching apparatus of claim 3 wherein said connecting means includes a first hollow tube, said support means including a pair of hollow, parallel second tubes spaced vertically apart and aligned generally vertically one above the other; said frame extending between said tubes with said first tube generally parallel to said second tubes, said magnets constantly spacing said first tube from said second tubes via said magnetic repulsion force.

6. The stretching apparatus of claim 5 wherein said first and second tubes each have a midpoint and first and second portions extending in opposite directions on opposite sides of the midpoints thereof; said magnets in said first portions of said first and second tubes having their magnetic poles reversed with respect to the poles of said magnets in said second portions of said tubes whereby said first tube and frame is repelled away from said second tubes regardless of whether it is inverted or right side up.

7. The stretching apparatus of claim 1 wherein said frame has a central axis parallel to the direction in which said fabric is drawn over said frame, a pair of elongated stretching members each including an outside, lateral rod portion forming one outer side boundary of said frame and an inside bracing rod portion, and a pair of axially aligned hollow tubes, each tube extending transversely of and connecting said inside and outside rods, said outside rod having an arcuate portion for initially contacting and expanding said tubular fabric, and a separate tubular member of predetermined length telescoped within said axially aligned tubes for connecting and spacing said stretching members a pedetermined distance apart.

* * * * *

UNITED STATES PATENT AND TRADEMARK OFFICE

CERTIFICATE OF CORRECTION

PATENT NO. : 3,955,251

DATED : May 11, 1976

INVENTOR(S) : Warren Hogendyk

It is certified that error appears in the above-identified patent and that said Letters Patent are hereby corrected as shown below:

Column 3, line 58;
"2b" should be --27b--;
Column 3, line 61;
"2b" should be --27b--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*